United States Patent [19]

Asai et al.

[11] 4,042,428

[45] Aug. 16, 1977

[54] PROCESS FOR HARDENING IRON-CONTAINING SURFACES WITH ORGANIC SOLVENT AND AMMONIA

[75] Inventors: Takeji Asai; Kaishu Yamazumi, both of Toyama, Japan

[73] Assignee: Kabushiki Kaisha Fujikoshi, Toyama, Japan

[21] Appl. No.: 611,079

[22] Filed: Sept. 8, 1975

[30] Foreign Application Priority Data

Feb. 28, 1975 Japan ..... 50-25265

[51] Int. Cl.[2] ..... C21D 1/48

[52] U.S. Cl. ..... 148/16.5; 148/16.6; 148/20.3; 148/31.5

[58] Field of Search ..... 148/16.6, 16.5, 16, 148/20.3, 31.5, 39; 260/585 B; 252/372, 373, 374

[56] References Cited

U.S. PATENT DOCUMENTS

| | | | |
|---|---|---|---|
| 2,703,298 | 3/1955 | Branson et al. | 148/16 |
| 3,387,032 | 6/1968 | Leonard | 260/585 B |
| 3,413,161 | 11/1968 | Goehring | 148/16.5 |
| 3,748,195 | 7/1973 | Kondo et al. | 148/16.5 |
| 3,783,007 | 1/1974 | Bloom et al. | 148/16.6 |

FOREIGN PATENT DOCUMENTS

| | | | |
|---|---|---|---|
| 875,998 | 8/1961 | United Kingdom | 148/16.6 |

OTHER PUBLICATIONS

Karrer; P., Organic Chemistry, New York, 1938, pp. 76–77.

*Primary Examiner*—Walter R. Satterfield
*Attorney, Agent, or Firm*—Spensley, Horn and Lubitz

[57] ABSTRACT

This invention relates to a method of carbonitriding an iron-containing article. The method comprises the steps of subjecting the article to a carbonitriding atmosphere which atmosphere contains ammonia and an oxygen-containing organic solvent. The ratio of the oxygen atoms to the carbon atoms in the solvent is from about 0.5 to 1.5; and maintaining the article in the carbonitriding atmosphere until at least the surface of the article has increased its carbon and nitrogen content a predetermined amount.

Inasmuch as the carbonitriding treatment of the instant invention has a propensity to produce "HCN" which is well-known noxious gas, as well as $NH_3$ and CO, it is also within the method of the instant invention to mix the gases used initially to contact the iron-containing article with a fuel gas and remove such a mixture of gases from the furnace where the mixture is subsequently burned thereby decomposing and detoxifying the HCN contained in the exhaust gas.

3 Claims, 5 Drawing Figures

Fig. 1
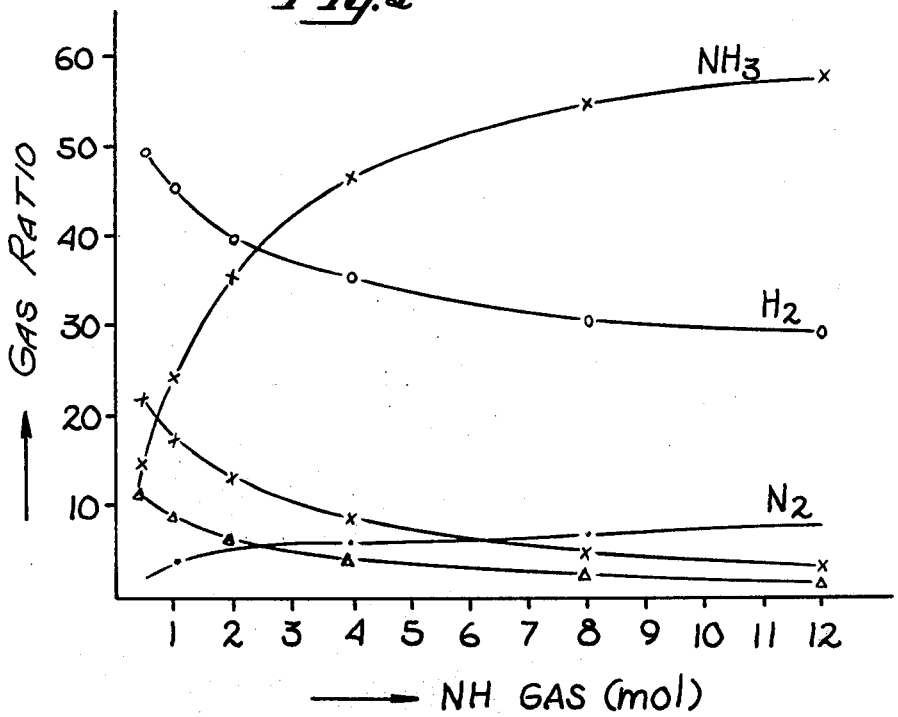
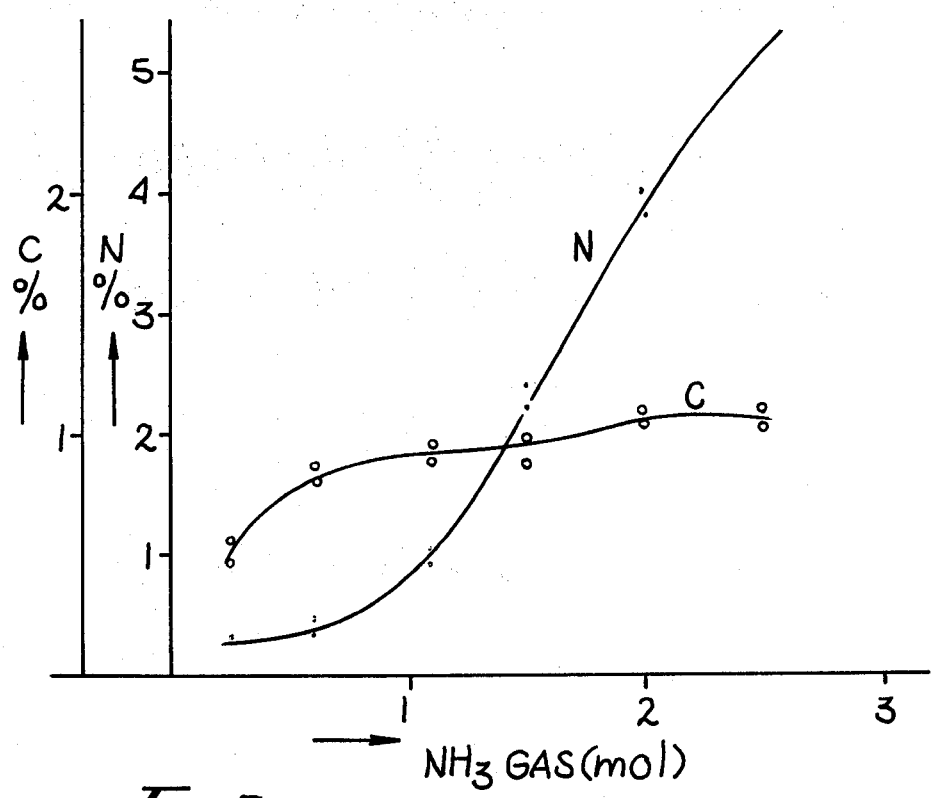
Fig. 2

PROCESS FOR HARDENING IRON-CONTAINING SURFACES WITH ORGANIC SOLVENT AND AMMONIA

BACKGROUND OF THE INVENTION

1. Field of the Invention

This invention relates to the field of an improved method for hardening the surface of steel and cast iron, and, more specifically, to a carbonitriding process for iron-containing articles.

2. Prior Art

Surface hardening methods which make use of the usual nitriding processes have in the past depended upon ammonia gas or molten salt bath nitriding. Of these, the ammonia gas nitriding method has the severe drawback of lengthened treating times and producing a brittle layer on the article. As for the salt bath nitriding method, a surface layer is also produced which needs after-treatment. In addition, the salt bath used is highly toxic.

As the term "carbonitriding" implies, this known process is a combination of carburizing and nitriding. Carburizing involves the application of carbon to a ferrous metal article with the object of increasing the carbon content of the surface and in some cases the nitrogen content as well. This is done such that when the article is subjected to a suitable heat treatment, the surface portion thus carburizes, resulting in a substantially harder surface than the underlying metal. This has been known in the art as "case hardening". Prior art methods of carburizing have been accomplished by a variety of different methods such as, for example, pack carburizing, gas carburizing, carbonitriding and liquid carburizing. The mechanism of the carburization of steel involves a diffusion of the carbon into the steel itself. Thus, the theory behind this process is related to the law of diffusion.

Pack carburizing referred to above involves a method wherein carbon is formed on the surface of the steel by the decomposition of carbon monoxide into carbon and carbon dioxide. The carbon dioxide that is formed reacts immediately with the incondensed carbon in the compound to produce fresh carbon monoxide. This process is repeated as long as there is enough carbon present to react with the excess of carbon dioxide. The decomposition of carbon monoxide occurs at the surface of the steel which must therefore be at a temperature such that the carbon form will dissolve into the steel. The usual commercially used carburizing compounds contain a mixture of approximately 20% alkali or other metal carbonates burned to a hardwood charcoal by the use of oil, tar and the like. In the operation of this method, the pieces to be carburized are packed into a box and a layer of the compounds is disposed about them. As very high temperatures are used, the boxes used to contain the articles to be carburized are relatively expensive and are usually made of a nickel-chromium alloy. The articles are then heated to a carburizing temperature of between 675° and 700° C where the above reaction takes place.

In gas carburizing, the carbon of the furnace atmosphere is in the form of gaseous hydrocarbon compounds or carbon monoxide. In order to transfer the carbon to the steel, the gaseous compound must react with the steel on the surface or in the immediate subsurface of the article. Usually, a reaction wherein methane gas is broken down into its various components is used in gas carburizing.

Finally, liquid carburizing is a method in which the steel or iron is placed in a molten salt bath that contains the chemicals required to produce a chafe comparable with one resulting from pack or gas carburizing. Carburizing in liquid baths provides a method for case hardening with load distortion but requires the use of difficult-to-work-with materials such as barium cyanide and the like. The carburizing bath usually operates at a temperature of about 1600° F and the piece is placed in the bath for a predetermined length of time such that the carbon diffuses into the surface of the metal.

On the other hand, cyaniding is substantially the same as carbonizing but, in this case, CN is what is being diffused into the surface. Cyaniding is known in the art to produce a hard, superficial wearing surface on various steel articles. Steels treated by this method absorb both carbon and nitrogen from, for example, a molten salt bath, and when quenched in water or in suitable oil, they develop the aforementioned hardness in their outer surface. In the prior art, sodium cyanide in the form of a bath is widely used. However, cyanides are known to be violent poisons and therefore such process is dangerous and relatively expensive to carry out. Baths of the sodium cyanide are employed as the heating or reheating medium in connection with the hardening of steels and act as a liquid medium for case carburizing affording a quick means of obtaining a hard superficial wearing surface. Ordinarily, cyaniding is carried out at a temperature just higher than the upper transformation point of the core of the article and the steel is generally quenched directly from the cyaniding temperature. This temperature in the case, which does not approach a tool steel composition and which has not been held for a sufficient length of time to cause brittleness from excessive grain growth, or quenched to the desired hardness in the core, will be thoroughly refined and tough.

Nitriding is a process which consists of subjecting the steel to the action of a nitrogen medium, generally ammonia gas, under conditions whereby high surface hardness is imparted to the steel without necessitating any further treatment. Nitriding is generally accomplished utilizing a relatively low temperature in which the parts are hardened and does not require quenching after exposure to the ammonia gas. Under this process, the parts are subjected to the ammonia gas at a high temperature which produces nitrogen, which is very active at the moment of the decomposition of the gas, provides to a certain extent the alloying elements of the steel to form nitrides. These nitrides, in a fine state of dispersion in the case, impart extreme hardness to the surface of the steel, a hardness that generally decreases in (relief) until it corresponds to that of the core.

Combining these two methods of carburizing and nitriding has led to the use of a method called carbonitriding or gas cyaniding. This is a process for case hardening a steel part in a gas carburizing atmosphere which contains ammonia gas in controlled percentages. Both carbon and nitrogen are additive steel; the nitrogen serves chiefly to reduce the critical cooling rate of the case and the carbon content of the gas is controlled as hereinbefore described. The nitrogen content of the surfaces is controlled by maintaining the desired ammonia content in the furnace atmosphere through varying the amount of the ammonia added.

The nitrogen and carbon contents of a steel part after carbonitriding at a given temperature decrease from the surface to the core, and since both the nitrogen and carbon contents have a pronounced effect on the critical cooling rate, the depth of the case must always be conditioned in terms of the depth of the effective or hard case. Carbonitriding is no different in this respect from the other methods mentioned hereinabove for producing carbon-nitrogen case.

Thus, the prior art methods, while they may be adequate to produce a good case-hardened article, are either expensive or require the use of exacting techniques and dangerous chemical process steps. The present invention represents an advancement in the art of carbonitriding and contains none of the aforementioned shortcomings associated with prior art production methods. The present invention utilizes an after-burner technique for any HCN which should be produced in the instant method. Thus, even if the present method should produce a "noxious" gas, it is effectively burned and therefore renders the instant method relatively safe to use. Inasmuch as the only gases which need be used in order to carbonitrize the metal are relatively inexpensive ammonia gas and well-known organic solvents, the expense associated with the initial method is substantially reduced especially when compared with that of maintaining metal salt baths and the like.

BRIEF SUMMARY OF THE INVENTION

The present invention relates to a method for carbonitriding an iron-containing metal structure comprising the steps of placing the metal structure in a furnace structure; supplying the furnace with a carbonitriding atmosphere (the atmosphere in the preferred embodiment comprises a mixture of ammonia gas and an oxygen-containing organic solvent wherein the ratio of the oxygen atoms to the carbon atoms in the solvent is from about 0.5 to 1.5); maintaining the structure in the furnace in the carbonitriding atmosphere until at least the surface of the structure has increased its carbon and nitrogen contents a predetermined amount; and removing the structure from the furnace. After the carbonitriding atmosphere contacts the structure, it is mixed with a fuel gas and removed from the furnace where it is burnt. In the preferred embodiment, the carbonitriding takes place in a uniquely designed furnace structure which furnace structure permits the selective introduction of both the carbonitriding atmosphere (containing the ammonia and organic solvent mixture gas) and a means for introducing a fuel gas which mixture is then burnt outside of the furnace.

The novel features which are believed to be characteristic of the invention both as to its organization and method of operation, together with further objectives and advantages thereof, will be better understood from the following description considered in connection with the accompanying drawings in which a presently preferred embodiment of the invention is illustrated by way of example. It is to be expressly understood, however, that the drawings are for the purpose of illustration and description only, and are not intended as a definition of the limits of the invention.

BRIEF DESCRIPTION OF THE DRAWINGS

FIG. 1 is a composite diagram of gases of decomposition in the exhaust gas produced when one mole of methanol ($CH_3OH$) is supplied with one to 12 moles of ammonia gas.

FIG. 2 shows an example of the N/C potential resulting when one to 12 moles of ammonia gas is supplied along with one mole of methanol, both at a temperature of 550° C.

DETAILED DESCRIPTION OF THE INVENTION

Figure 3:
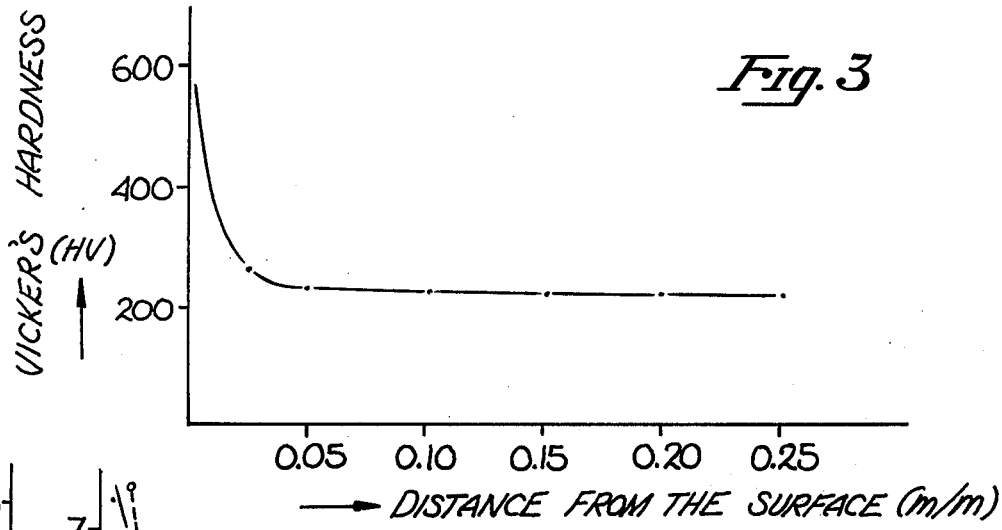
FIG. 3 is a micro-hardness distribution diagram of a sample of the instant invention.

Nitriding by means of commonly used gas nitriding processes uses ammonia gas as the nitriding agent. In accordance with the following reaction, the nitrogen produces a nitriding effect in the steel material. The nitriding temperature is under the transformation point of the steel, being in effect below about 650° C, i.e., $$NH_3 \rightleftarrows N + 3/2\ H_2.$$

With regard to high-speed steel, the consequence of the treatment is that the concentration of nitrogen increases from the core of the material outward to the skin according to the following representation:

$$(\alpha+\theta) - (\alpha-\gamma'+\theta) - (\gamma'+\theta) - (\epsilon+\theta+\gamma') - (\gamma'+\epsilon) - \epsilon$$

As with low-carbon steel, the nitrogen concentration increases as represented by the following formula:

$$(\alpha+\theta) - (\alpha+\gamma'+\theta) - (\alpha+\gamma') - (\gamma') - (\gamma'+\epsilon) - (\epsilon)$$

to form the nitrogen soluted phase. However, there is no reason to suppose these phases, which depend upon the degree of dissociation of the ammonia and the treatment method, will appear in all steel materials.

In these phases when the solute is carbon, the heat-resistance hardness and abrasion resistance rise in accordance with the quantity of carbon. The $\epsilon$-nitride layer, especially when it exists as the $\epsilon$-carbonitride layer, shows a considerable increase in abrasion resistance. It is known in the art that the highest abrasion resistance is made possible by the $\epsilon$-carbonitride phase of high carbon content. Moreover, it is widely known that the fatigue strength of a material increases when nitrogen is introduced having a content of greater than 0.01% and when this percentage permeates the surface of the steel material inward to the core to a depth of more than 0.1 mm.

This invention enables one to achieve these limits by the use of the invented method steps. In order to solve a commonly encountered problem, a carbonitriding method which causes the simultaneous penetration and diffusion of carbon and nitrogen is disclosed. A further explanation of the various steps is also set forth in Japanese Patent Application No. 46-52738. While that application does set forth some of the provisions of the instant invention, there is nothing in that application which has to do with the disposal of the harmful HCN and other toxic gases created in the instant method. This invention is concerned with the improvement of the above-mentioned invention disclosed in the above-referenced patent application. The instant invention uses the gases of decomposition of an organic solvent together with ammonia gas as carburizing and nitriding reagents. The invention involves the use of a non-polluting low-temperature carbonitriding process which provides surface hardening and increases in heat resistance, abrasion resistance, and fatigue strength, and in addition, decomposes and renders substantially non-toxic the cyanide (HCN) contained in the exhaust gas from the carbonitriding furnace.

In order to expedite the carburizing phenomena and simultaneously heighten the nitrogen potential, this invention provides for the decomposition of ammonia gas in a uniquely designed furnace to make a nitriding atmosphere. A carbonizing gas formed by an alcohol, ketone, or ether-type compound or a mixture thereof is supplied to the furnace at the same time as the ammonia gas. When the oxygen-containing compound is introduced into the furnace, it is vaporized and decomposed. In this manner it forms a carbonizing atmosphere together with the gas from the ammonia which forms a nitriding atmosphere. These, then, are the presently preferred means to form the carbonitriding treatment.

When the carbonitriding treatment atmosphere is created in the furnace, as indicated in the formulas below, HCN is synthesized and a gas is exhausted which may contain noxious gases such as HCN, $NH_3$, and CO in large quantities.

$$CH_3OH + CO \rightarrow HCOOCH_3$$
$$HCOOCH_3 + NH_3 \rightarrow HCONH_2 + H_2O$$
$$HCONH_2 \rightarrow HCN + H_2O$$

Among the noxious gases the toxicity of HCN in particular is very great. Moreover, it is known that it may be dangerous to release such kind of a gas into the atmosphere for ecological reasons. This invention also includes the steps of mixing the exhaust gases with a fuel gas and then burning it outside of the atmosphere where the noxious gases are caused to decompose and detoxify.

Exhaust gases which are discharged during carbonitriding treatment contain large quantities of combustible gases such as hydrogen, carbon monoxide and the like which burn easily at the mouth of the exhaust of the furnace upon contact with air. At the same time noxious gases such as $NH_3$ and HCN also burn simultaneously. However, it is necessary to either purge the air which has infiltrated into the furnace for treatment with a generally neutral gas or to purge the gases, including the noxious gases, from the furnace after the treatment. For economic reasons, nitrogen gas is generally used as a neutral purging gas. However, during the latter part of the purging, the quantity of combustible gases at the exhaust of the furnace decreases to a level below combustibility. When this happens, minute quantities of noxious gases contained in the exhaust gases are released into the atmosphere. Accordingly, the particular feature of the present invention is to burn and detoxify noxious gases simultaneously by adding a fuel gas such as methane gas or propane gas so as to increase the quantity of combustible gas to within the burning level.

Figure 5:
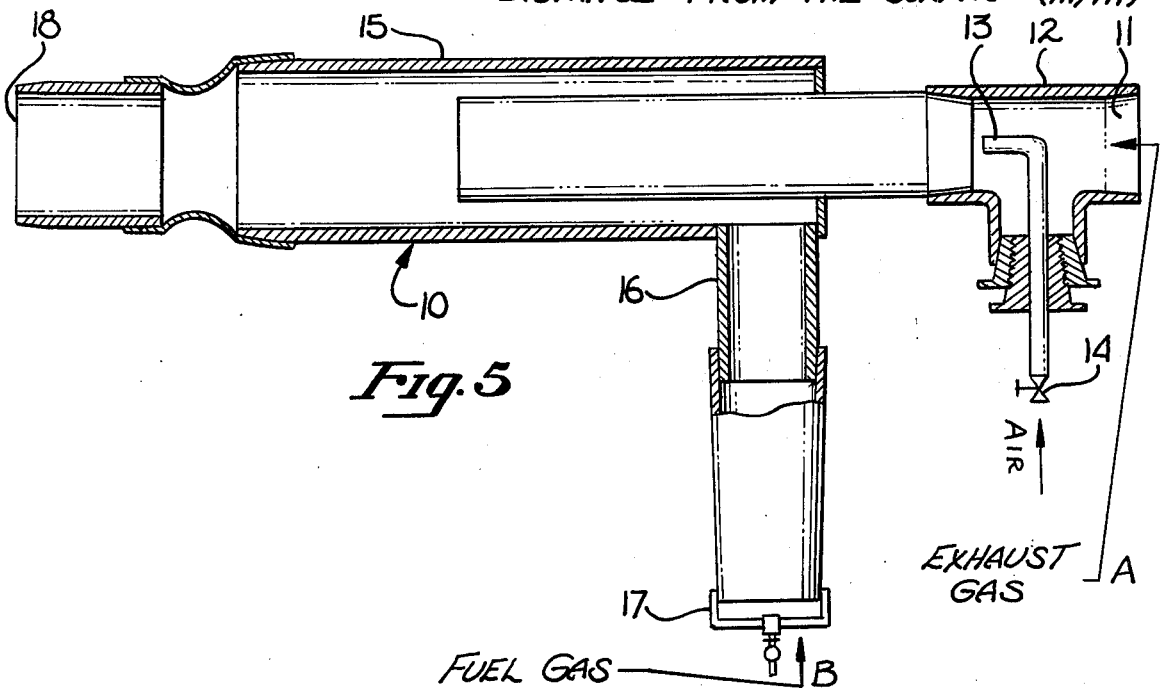
FIG. 5 is a cross-sectional drawing of the exhaust gas combustion furnace and related burner showing how the inlet carbnitriding atmosphere and the fuel gases are introduced into the furnace.

Referring now to FIG. 5, the connecting port of a combustion burner or furnace 10 is connected to the exhaust port of a carbonitriding furnace (not shown) by which gases are introduced as indicated by the letter "A". Gas introduced thus represents the exhaust gas from the carbonitriding furnace. As a necessary circumstance, air is also supplied by an air-charging pipe 13 which opens into a T-shaped connecting pipe 12 and is mixed with this exhaust gas. Valve 14 is used to regulate the volume of air into the mixing chamber 11.

The fuel gas supply pipe 16 also opens into the inner wall of the body 15 of the combustion burner 10. As arrow B indicates, the fuel gas such as propane passes through the valve 17 and the supply pipe 16 and is fed into the interior of the burner body 15 where it is mixed with the exhaust gas. In this way, the exhaust gas which has been mixed with the fuel gas is blown out the burner mouth 18 where it is ignited and burned outside the furnace. It is obvious that since the exhaust gas is mixed with the fuel gas which burns in the atmosphere outside of the furnace, the provisions of pre-mixing with the air from the air-charging pipe 13 are not strictly necessary. However, in the presently preferred embodiment, where the air is premixed according to the density and other factors, such as, for example, the specific composition of the exhaust, the combustion is complete. Thus, the eviction of air through this air-charging pipe 13 increases the efficiency of the means to dispose of the noxious gases.

In low temperature carbonitriding, the dispersal and permeation of carbon into the steel are lower than the dispersal and permeation of nitrogen thus requiring greater efforts to be expended to prevent the formation of soot. It is known from experimental results that this may be achieved by regulating the ratio of the carbon atoms to the oxygen atoms in the organic solvent. It has been found that the specific ratio of carbon: oxygen of 0.5:1.5 is a critical limitation to prevent the formation of soot. While other ratios may work, this ratio has been found to be the only ratio where the formation of soot is substantially diminished.

Moreover, it has been found that the formative phase of the carbonitriding atmosphere gas in the furnace, when the nitriding potential is low in comparison to the carburizing potential, a nitrogen-soluted carbonitride in cementite ($Fe_3C$) crystalline structure forms on the surface. In the case where the nitriding potential is high in comparison to the carburizing potential, $\epsilon$-carbonitride in solution with the carbon in a carbon-containing $Fe_3N$ crystalline structure is produced. As a consequence, it is also a goal of this invention to raise the nitriding potential in comparison to the carburizing potential. In an experiment where one mole of organic solvent was fed drop by drop into the furnace at the same time as ammonia gas, with less than one mole of ammonia, the nitriding potential dropped and it was found that it was now difficult to form the $\epsilon$-carbonitride on the surface. Again, when it was found that more than 12 moles were added, the carburizing potential dropped. As a consequence through this experiment, it has been concluded that one mole organic solvent requires from 1 to 12 moles of ammonia ($NH_3$) gas.

FIGS. 1 and 2 show an example of N/C potential along with the composition of the gases of dissociation from the exhaust gas produced when 1 to 12 moles of ammonia gas was supplied in combination with one mole of methanol at 550° C.

The following examples are presented for the purpose of illustrating the manner in which the present invention is conducted and the advantages obtained thereby. The examples are illustrative only and are not to be construed as limitative.

EXAMPLE 1

Figure 4:
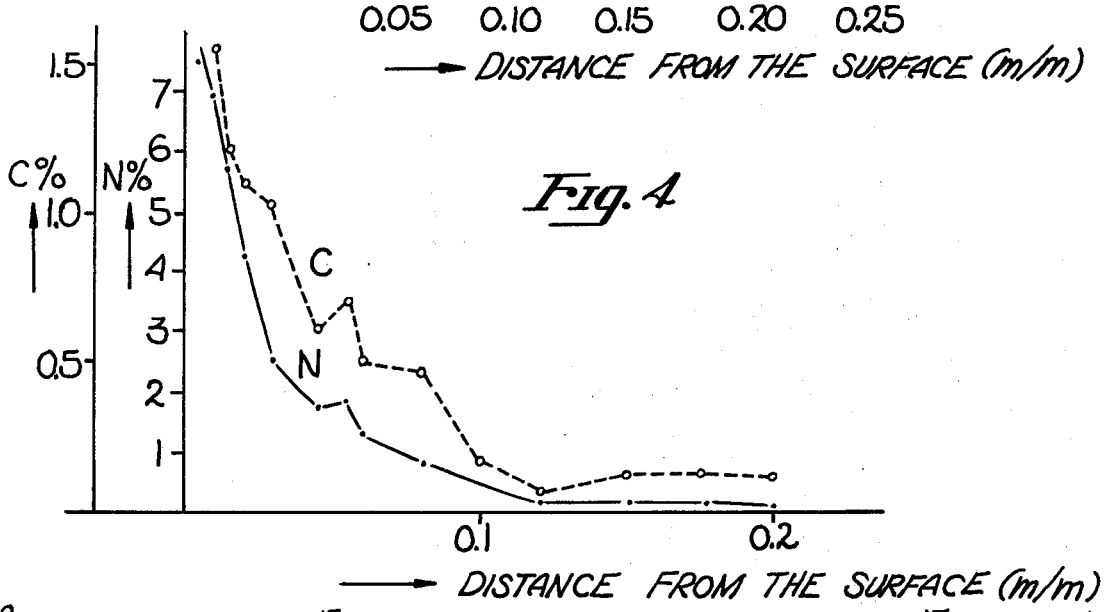
FIG. 4 is a distribution diagram of N/C concentration in a typical operational example of this invention.

A rotation-bending test piece with a diameter of 6.0 mm. made of 0.1% carbon steel revealed a failure strength of 1.25 kg-m. This test piece was placed in a furnace and a ratio of one mole of methanol to 3 moles of ammonia gas was supplied in order to form the carbonitriding atmosphere gas. The fatigue strength of the test piece, which was treated at 570° C for 90 minutes and then air cooled, increased to 2.5 kg-m. The microhardness distribution and N/C density distribution are as noted in FIGS. 3 and 4.

EXAMPLE 2

A drill bit made of high speed tool steel was treated in a furnace with one mole of a gas that had been made by the decomposition of 0.7 mole of ammonia gas with methanol in a gas generator at 900° C. The drill that was given carbonitride treatment at 550° C for 50 minutes was capable of 1238 drilling repetitions, as opposed to an untreated drill with 91 drilling repetitions.

EXAMPLE 3

The content (volume percent) of HCN contained in exhaust produced when heats of 500° C, 550° C and 600° C were applied to one mole of ammonia gas and 4.5 moles of methanol introduced into the furnace simultaneously was, respectively, 3170 ppm, 4330 ppm, and 6020 ppm. A burner was used which mixed air and a fuel gas with the exhaust gas in the manner shown in diagram 5. The fuel gas added was propane gas. The HCN content after the mixture was burned outside the furnace was, respective to the above temperatures, 1.7 ppm, 1.7 ppm, and 1.9 ppm.

Since carbonitriding treatment according to this invention causes carbon and nitrogen simultaneously to permeate and diffuse, as stated above, a brittle compound layer does not form on the surface and short-period treatment is made possible. Moreover, since the ε-carbonitride layer is formed on the surface the resistance to heat and abrasion as well as fatigue strength are markedly increased. With respect to exhaust gas, HCN and other noxious gases are effective and completely eliminated because the exhaust gas is mixed with fuel gas and burned outside the furnace. Besides becoming non-toxic, the exhaust gas needs no after-treatment; thus it is possible to obtain results that are economically and operationally superior.

It is to be understood that while the preferred examples described herein have shown a specific structure as the after-treatment chamber, other after-treatment chambers are also within the scope of the invention. It will therefore be apparent to one of ordinary skill in the art that other changes and modifications can be made herein without departing from the spirit and scope of the invention as defined herein.

We claim:

1. A method for carbonitriding an iron containing metal structure comprising the steps of:

heating a furnace to the transformation point of steel, said transformation point being below about 650° C;

placing said metal structure in said furnace;

supplying said furnace with a carbonitriding atmosphere comprising a mixture of ammonia gas and a vaporized and decomposed oxygen containing liquid organic solvent wherein the ratio of carbon atoms to oxygen atoms in the liquid organic solvent is from 0.5 to 1.5 and wherein the ratio of moles of liquid organic solvent to moles of ammonia gas is from 1:1 to 1:12;

maintaining said article in said carbonitriding atmosphere until at least the surface of said iron-containing article has increased its carbon and nitrogen content a predetermined amount;

removing said carbonitriding atmosphere from said furnace;

mixing said removed carbonitriding atmosphere with a fuel gas;

burning said mixture of fuel gas and said removed carbonitriding atmosphere; and removing said structure from said furnace.

2. The method for carbonitriding according to claim 1 wherein said step of mixing said fuel gas with said removed carbonitriding atmosphere comprises mixing a fuel gas with said carbonitriding atmosphere of sufficient proportions to produce a combustible mixture.

3. The method for carbonitriding according to claim 2 wherein said fuel gas is propane.

* * * * *